United States Patent [19]

Plummer

[11] 4,136,910

[45] Jan. 30, 1979

[54] EXCAVATING MACHINES

[75] Inventor: Derek Plummer, Burton upon Trent, England

[73] Assignee: Coal Industry (Patents) Limited, London, England

[21] Appl. No.: 621,374

[22] Filed: Oct. 10, 1975

[30] Foreign Application Priority Data

Oct. 30, 1974 [GB] United Kingdom ..... 46943/74

[51] Int. Cl.[2] ..... E21C 25/06; E21C 29/02

[52] U.S. Cl. ..... 299/31; 299/33; 299/64; 299/75

[58] Field of Search ..... 299/31, 33, 56, 75, 299/55, 58, 64

[56] References Cited

U.S. PATENT DOCUMENTS

| | | | |
|---|---|---|---|
| 1,332,662 | 3/1920 | Gross | 299/64 |
| 2,788,202 | 4/1957 | Barrett | 299/64 |
| 3,404,920 | 10/1968 | Tabor | 299/33 |
| 3,467,436 | 9/1969 | Pentith et al. | 299/75 X |
| 3,498,675 | 3/1970 | Kampf-Emden et al. | 299/31 |
| 3,612,609 | 10/1971 | Reuls | 299/33 |
| 3,713,700 | 1/1973 | Montacié | 299/31 |
| 3,773,387 | 11/1973 | Montacié | 299/56 X |
| 3,784,257 | 1/1974 | Lauber et al. | 299/31 |

*Primary Examiner*—Ernest R. Purser
*Assistant Examiner*—William F. Pate, III
*Attorney, Agent, or Firm*—James C. Wray

[57] ABSTRACT

The excavating machine has a cutter carrying boom carried by a boom support member which can be swung about an axis extending in the direction of the roadway. The machine includes a cutter unit and a stay unit each of which is releasably anchorable in the roadway and each of which can be advanced relative to the other unit.

16 Claims, 3 Drawing Figures

EXCAVATING MACHINES

This invention relates to excavating machines. In particular, although not exclusively, the present invention relates to a rock excavating machine which cuts and loads rock from a working face to extend an underground mine roadway which is subsequently supported by arch-section roadway supports.

With prior known excavating machines it is common to have a rotary cutter head mounted on an elongated boom extending in advance of the machine and for the machine operator to sweep or traverse the boom so that the cutter head cuts rock from the whole of the working face to extend the roadway and to allow a further arch-section support to be set.

Unfortunately, with such machines the operator tends to be remote from the cutter head. Consequently, the operator has difficulty in seeing the cutter head, especially as it tends to be surrounded by a cloud of dust particles generated during cutting. The operator has to estimate or guess when sufficient rock has been excavated to enable an arch-section support to be set. In order to make sure sufficient rock has been excavated it tends to be common practice for rock to be excavated from the sides and roof of the roadway far in excess of that required. Consequently, when the arch-section support is set the rock boundaries of the roadway tend to be relatively remote from the support. Thus, the arch-section support tends not to provide adequate support to the rock strata often resulting in poor roof conditions adjacent to the roadway. In addition, prior known machines usually have the boom pivotally mounted about two mutually normal axes, i.e., one horizontal and one vertical, which means when cutting around the so called curved profile of the roadway the cutter head tends to be moved in a series of alternate horizontal and vertical motions giving rise to a stepped cut profile. Thus, the cut profile differs from the shape of the support arches tending to make efficient support of the roadway difficult.

An object of the present invention is to provide an improved excavating machine which tends to overcome the above mentioned disadvantages.

According to the present invention an excavating machine for forming an underground roadway at least a part of a rock boundary of which is of arcuate form, comprises a cutter unit and a stay unit, each of which is anchorable in the roadway and each of which is releasable and advanceable along the roadway with respect to the other unit, advancing means for advancing in use the currently released unit with respect to the currently anchored unit, a boom support member carried by the cutter unit for movement about an axis extending along the roadway, a forwardly directed rotary cutter-carrying boom pivotally mounted on the boom support member, ram means for controlling pivotal movement of the boom, a mechanism for moving the boom support member about said axis such that in use a rotary cutter mounted on the boom cuts the arcuate form of the rock boundary, and loading means arrangeable in use to collect and convey broken rock cut by the rotary cutter.

Preferably, the boom support member includes a shaft mounted in a bearing provided on the cutter unit, the axis of the shaft extending in a direction along the roadway.

Advantageously, said mechanism for moving the boom includes a gear wheel drivably connected to the shaft, and drive means for rotating the gear wheel.

Conveniently, the drive means includes motor means drivably connected to the gear wheel.

Advantageously, the cutter unit comprises a floor mounted skid supporting an upright support component carrying the bearing and a roof support shield arrangeable around the arcuate form of the rock boundary.

Preferably, a number of guide rod means extend rearwardly from the cutter unit to slidably engage the stay unit.

Preferably, a stabilizing unit is provided on the rearmost end of the guide rod means.

Preferably, the loading means comprises an endless conveyor, a portion of which is carried on an apron provided on the cutter unit.

Advantageously, the conveyor feeds broken rock onto a further conveyor the loading end of which is carried by the stay unit.

By way of example only, one embodiment of the present invention will be described with reference to the accompanying drawings in which.

Figure 1:
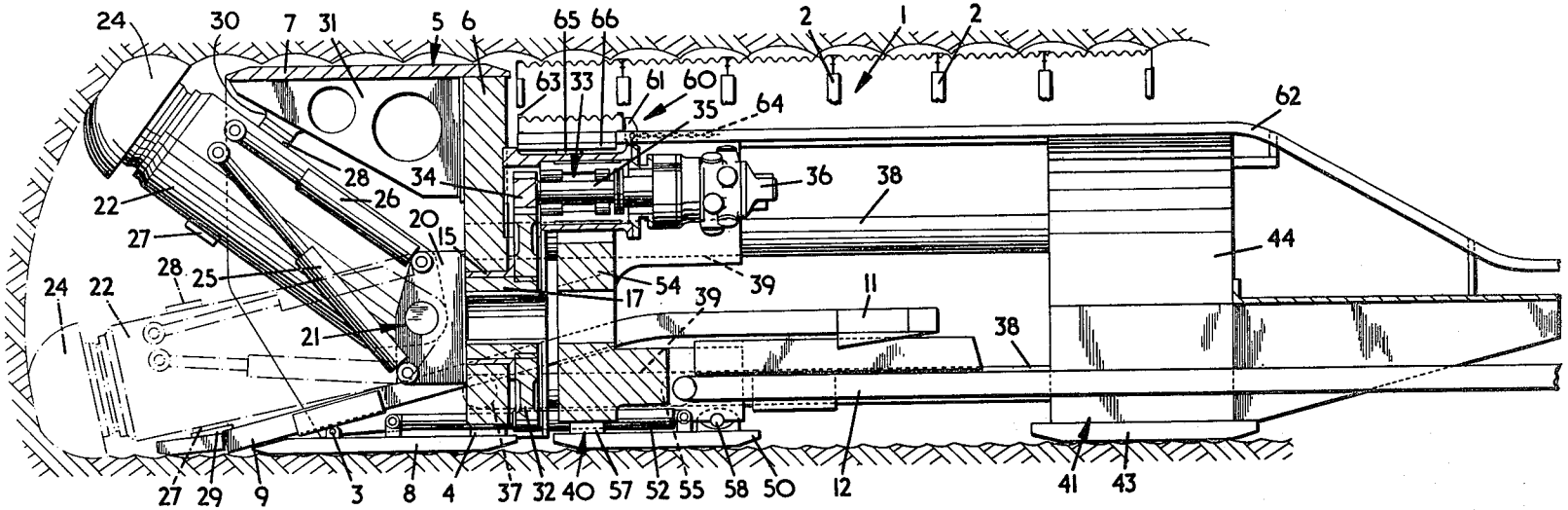
FIG. 1 is a side view, partly in section, of an excavating machine constructed in accordance with the present invention and shown in an operational position.

Referring to the drawings, the excavating machine is shown in an operational position in an underground mine roadway 1, a portion of the rock boundary sides and roof of which are of a preselected arcuate form to suit arch-section roadway supports 2 which are set along the roadway as the machine extends the roadway. The excavating machine comprises a cutter unit 5 including an upright partly annular support component 6 extending across the roadway, a roof support shield 7 secured around the upper and side curved portions of the support component 6 and a floor mounted skid arrangement 8 supporting the support component 6 via pivot assemblies 3 and height adjustment jacks 4. A loading apron including an endless conveyor 9 passing through cut outs formed in the upright support component 6 is carried around four guide sprockets 10 carried by the cutter unit for loading cut rock from adjacent to the newly formed roadway floor and conveying it towards a chute 11 located over a further conveyor 12 extending along the roadway 1. The chute 11 is slidably mounted on the conveyor 12 to permit limited relative advance of the cutter unit and the conveyor 12.

The upright support component 6 is provided with a bearing 15 supporting a shaft 17 for rotation about an axis extending in a direction along the roadway. In the embodiment shown in the drawings the axis extends parallel to the longitudinal axis of the roadway. In other embodiments the axis of rotation may be inclined to the longitudinal axis of the roadway. The shaft 17 is part of a boom support member 20 which is mounted on the support component 6 for movement about the axis of the shaft 17 and which provides a pivot bracket support 21 for a forwardly extending boom 22 carrying a rotary cutter 24 on its forward most end. In FIG. 1 the boom and cutter are shown in two alternative operational positions. Pivotal movement of the boom 22 is controlled by two pairs of hydraulic rams 25 and 26 pivotally connected between the boom and the boom support member 20. Two slide elements 27 and 28 (see FIG. 1) are provided on the boom 22 to slidably contact cooperating slides 29 and 30 provided on the loading apron and on gussets 31 supporting the roof shield 7 to limit outward pivotal movement of the boom to within preselected limits.

The shaft 17 of the boom support member 20 is rotated in the bearing 15 provided on the upright support component 6 by a gear wheel 32 drivably mounted on the shaft 17 which is simultaneously engaged by a pair of drive means 33 each comprising a gear wheel 34 drivably engaging the gear wheel 32 and gearing 35 driven by a hydraulic motor 36.

The cutter unit 5 has a pair of opposed horizontal hydraulic rams 37 engageable with the rock boundary sides of the roadway to releasably anchor the cutter unit in the roadway.

The rotary cutter 24 is driven via a slow speed gearbox housed within the boom by a drive motor also housed within the boom. In a typical example it is expected the rotary cutter would be rotated at approximately two revolutions per minute.

The cutter unit 5 has a number of guide rod means constituted by four guide rods 38 slidably engaged in bores 39 provided on a stay unit 40. A rear unit 41 provided on the rearmost ends of the guide rods 38 to help stabilize the cutter unit during cutting comprises a floor mounted skid 43 and a cabin 44 for housing auxiliary equipment for the machine, for example a powerpack drive including an electrically driven pump (not shown) arranged to feed hydraulic pressure fluid to actuate hydraulic equipment including rams on the machine.

The stay unit 40 comprises a floor mounted skid arrangement 50 inter-connected to the floor mounted skid arrangement 8 of the cutter unit 5 by double acting hydraulic rams 52, and an upright component 54 having the through bores 39 arranged to slidably engage the guide rods 38 as previously stated. The upright component 54 is generally "U"-shaped in plan. A pair of horizontally opposed hydraulic anchor rams 55 are provided for releasably anchoring the stay unit 40 within the roadway.

The stay unit 40 includes steering jacks 57 which adjust the height of the upright component 54 about pivot mountings 58 on the skid arrangement 50 to enable the stay unit to negotiate steps in the mine floor.

The stay unit 40 carries the loading end of the previously mentioned conveyor 12 which thereby is advanced with the stay unit.

Figure 2:
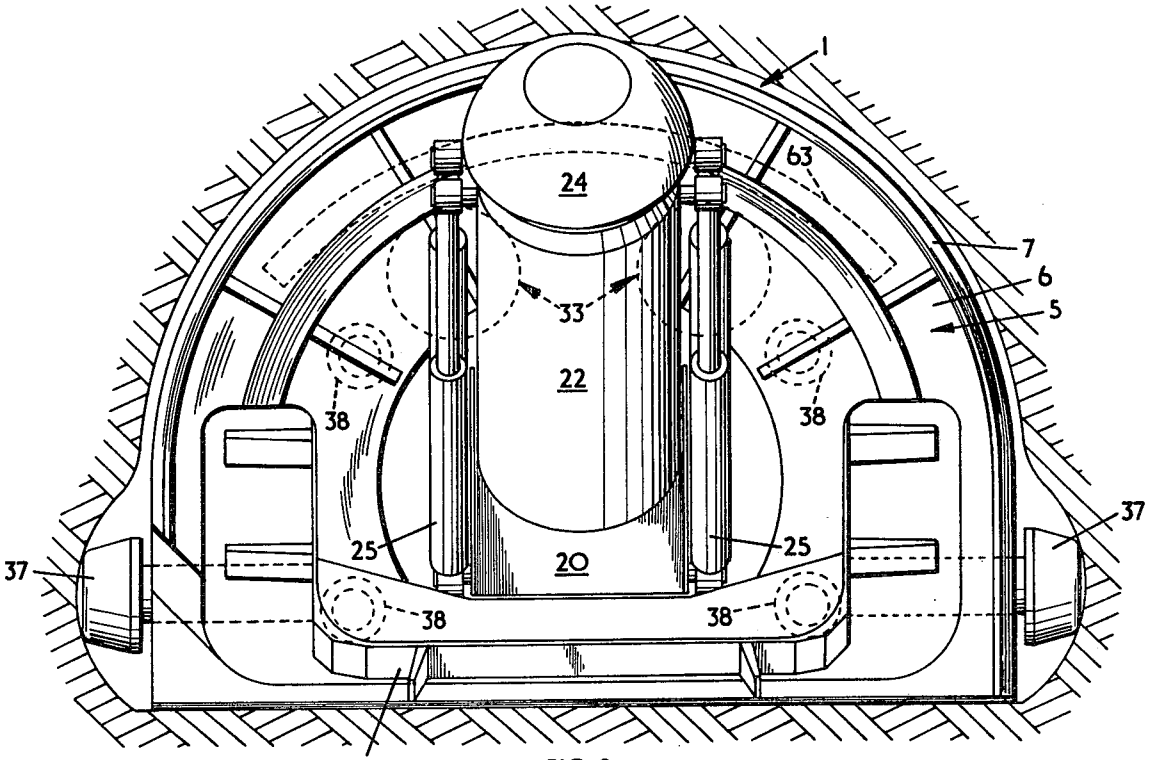
FIG. 2 is a front view of FIG. 1.
Figure 3:
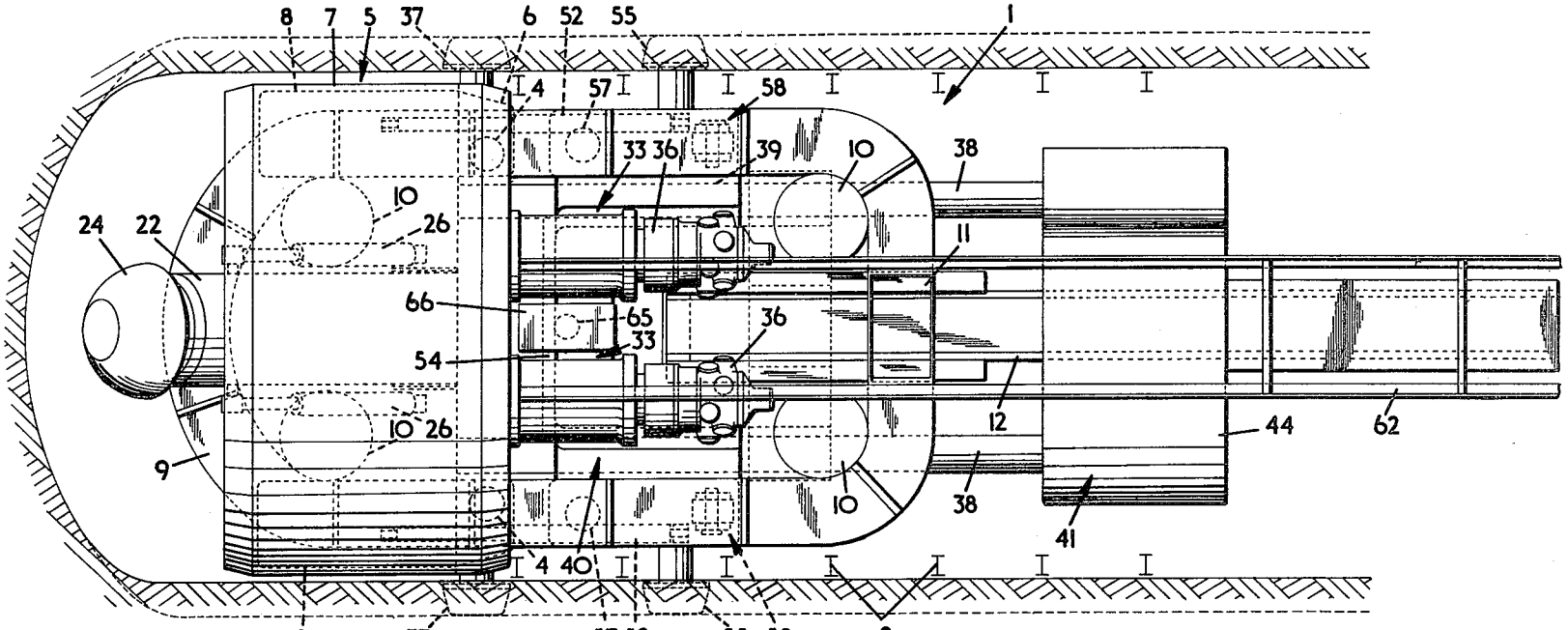
FIG. 3 is a plan of FIG. 1.

An arrangement 60 (only a part of which is shown in FIG. 1) is provided for transporting crown sections of the roadway roof supports from the rear of the excavating machine towards a setting position adjacent to the newly exposed arcuate rock boundary of the roadway roof. The roof support sections are placed on a carrying pawl 61 which is slid along a track 62 by an effectively endless haulage chain 64 (only a part of which is shown) which is driven by a hydraulic motor (not shown). Once the section (indicated by broken line 63 in FIG. 2) is in position adjacent to the newly exposed roadway an upright hydraulic prop 65 on the stay unit 40 is extended to lift a lifting platform 66 supporting the roof support section which thereby is raised to the mine roof. Leg sections of the roof support are then placed beneath the crown section and the assembly bolted together.

The prop 65 is retained in its extended position throughout cutting to help anchor the stay unit within the roadway.

In operation the stay unit 40 is anchored within the roadway by extension of rams 55 and the prop 65 and the released cutter unit 5 is advanced toward the working rock face by the extension of the advancing rams 52. During advance of the cutter unit the cutter 24 is rotated in order to sump into the rock face. When the cutter unit has been advanced the desired amount and the cutter is sumped into the rock face a sufficient amount, extension of the rams 52 is stopped and the anchor rams 37 are extended to anchor the cutter unit within the roadway. The cutter 24 is then traversed over the rock face until all the web of rock is excavated. Initially, the boom support member 20 is rotated by the drive means 33 via gear wheel 32 until the pivot support 21 for the boom is vertical. The cutter is then traversed across the roadway with the lower slide element 27 contacting the slide 29 on the loading apron. Thus the cutter forms the roadway floor. Next, with the cutter in its outermost position adjacent to the roadway side it is traversed around the roadway sides and roof by rotation of the boom support member 20 due to operation of the drive means 33. Thus, the cutter forms an arcuate rock boundary having similar form to the roadway roof supports which thereby are able to efficiently support the roadway. Outer movement of the boom during this latter traverse is limited by contact between the slide element 28 with the slide 30 carried on the roof shield gussets. The remainder of the web of rock is then excavated by pivoting the boom such that the cutter traverses across the remainder of the working face.

When all the web of rock has been excavated the cutter unit is released from its anchored position and is further advanced towards the working face in a manner as previously described by the advancing rams 52. The cutting operation is then repeated with the cutter unit anchored as previously described.

When the advancing rams 52 are fully extended the stay unit is advanced by releasing it from its anchored position by retracting rams 55 and prop 65 and actuating the rams 52 to haul the stay unit towards the anchored cutter unit. Once the stay unit is fully advanced a roof support crown section is fed onto the platform 66 over the prop 65 before this prop is extended towards the roadway roof and the rams 55 extended to anchor the stay unit within the roadway. The cutter unit may then be further advanced in a manner as previously described.

As the cutter and stay units are advanced the associated conveyors 9 and 12, respectively are also advanced, any relative movement of the two conveyors being accommodated by the chute 11 sliding along the slideway provided on the conveyor 12.

During advance and cutting, the cutter unit tends to be guided and stabilised by the action of the four guide rods 38 and by the stay unit 40 which tends to absorb thrusts transmitted from the cutter unit to the guide rods.

From the above description it can be seen that the present invention provides an excavating machine which enables an underground roadway to be formed which has a rock boundary of arcuate form tending to lead to efficient roof support conditions, the set arched roadway roof supports lying adjacent to the continuous arcuate rock boundary. Thus the roof supports can be assembled virtually in contact with the newly exposed roadway sides and roof.

In other embodiments of the invention the mechanism for moving the boom support member about an axis extending along the roadway may comprise at least one hydraulic ram. The mechanism may include ratchet and pawl means.

I claim:

1. An excavating machine for forming an underground roadway at least a part of a rock boundary of which is of arcuate form, comprising a cutter unit and a stay unit, each of which is anchorable in the roadway and each of which is releasable and advanceable along the roadway with respect to the other unit, advancing means for advancing in use the currently released unit with respect to the currently anchored unit, a boom support member carried by the cutter unit for rotational movement about an axis longitudinally extending along the roadway, a forwardly directed, rotary cutter-carrying boom pivotally mounted on the boom support member, ram means for controlling pivotal movement of the boom, a mechanism for moving the boom support member about said axis, a rotary cutter head mounted on the boom for cutting the arcuate form of the rock boundary, rotary cutter drive means carried by the boom for rotating the rotary cutter and loading means arrangeable in use to collect and convey broken rock cut by the rotary cutter.

2. A machine as claimed in claim 1, in which the boom support member includes a shaft mounted in a bearing provided on the cutter unit, the axis of the shaft extending in a direction along the roadway.

3. A machine as claimed in claim 2, in which said mechanism for moving the boom support member includes a gear wheel drivably connected to the shaft, and drive means for rotating the gear wheel.

4. A machine as claimed in claim 3, in which the drive means includes motor means drivably connected to the gear wheel.

5. An excavating machine for forming an underground roadway at least a part of a rock boundary of which is of arcuate form, comprising a cutter unit and a stay unit, the cutter unit having a floor mounted skid arrangement, an upright support component supported by the skid arrangement, and a roof support shield carried by the upright support component and arrangeable around at least a portion of the arcuate form of the rock boundary, each of the units being anchorable in the roadway and being releasable and advanceable along the roadway with respect to the other unit, advancing means for advancing in use the currently released unit with respect to the currently anchored unit, a boom support member carried by the cutter unit for rotational movement about an axis longitudinally extending along the roadway, a single forwardly directed, rotary cutter-carrying boom pivotally mounted on the boom support member, ram means for controlling pivotal movement of the boom, a mechanism for oscillating the boom support member about said axis, a rotary cutter head mounted on the boom end for rotating on an axis parallel to the boom for cutting the arcuate form of the rock boundary as the boom support member is oscillated and drive means carried by the boom for continuously rotating the cutter, and loading means arrangeable in use to collect and convey broken rock cut by the rotary cutter.

6. An excavating maching for forming an underground roadway at least a part of a rock boundary of which is of arcuate form, comprising a cutter unit and a stay unit, a number of guide rod means extending rearwardly from the cutter unit to slidably engage the stay unit, each of the units being anchorable in the roadway and being releasable and advanceable along the roadway with respect to the other unit, advancing means for advancing in use the currently released unit with respect to the currently anchored unit, a boom support member carried by the cutter unit for rotational movement about an axis longitudinally extending along the roadway, a forwardly directed, rotary cutter-carrying boom pivotally mounted on the boom support member, ram means for controlling pivotal movement of the boom, a mechanism for moving the boom support member about said axis, a rotary cutter head mounted on the boom for cutting the arcuate form of the rock boundary, drive means carried on the boom for continuously rotating the rotary cutter head and loading means arrangeable in use to collect and convey broken rock cut by the rotary cutter.

7. An excavating machine as claimed in claim 6, in which a stabilizing unit is provided on the rearmost end of the guide rod means.

8. An excavating machine as claimed in claim 1, in which the loading means comprises an endless conveyor, a portion of which is carried on an apron provided on the cutter unit.

9. A machine as claimed in claim 8, in which the conveyor feeds broken rock onto a further conveyor the loading end of which is carried by the stay unit.

10. An excavating machine for forming an underground roadway at least a part of a rock boundary of which is of arcuate form, comprising a cutter unit and a stay unit, each of which is anchorable in the roadway and each of which is releasable and advanceable along the roadway with respect to the other unit, advancing means for advancing in use the currently released unit with respect to the currently anchored unit, a boom support member carried by the cutter unit for rotational movement about an axis longitudinally extending along the roadway, a forwardly directed, rotary cutter-carrying boom pivotally mounted on the boom support member, ram means for controlling pivotal movement of the boom, a mechanism for rotating the boom support member about said axis, a rotary cutter head mounted on the boom for cutting the arcuate form of the rock boundary, drive means mounted on the boom for rotating the rotary cutter head, loading means arrangeable in use to collect and convey broken rock cut by a rotary cutter mounted on the boom, slide element means provided on the boom, and slide means provided on the cutter unit so as to be slidably engaged by the slide element means to limit pivotal movement of the boom to within a preselected range.

11. An excavating machine for forming an underground roadway at least a part of a rock boundary of which is of arcuate form, comprising a cutter unit and a stay unit, each of which is anchorable in the roadway and each of which is releasable and advanceable along the roadway with respect to the other unit, advancing means for advancing in use the currently released unit with respect to the currently anchored unit, a boom support member carried by the cutting unit for rotational movement about an axis longitudinally extending along the roadway, a forwardly directed, rotary cutter-carrying boom pivotally mounted on the boom support member, ram means for controlling pivotal movement of the boom, mechanism for moving the boom support member about said axis, a rotary cutter mounted on the boom for cutting the arcuate form of the rock boundary, and drive means on the boom for rotating the rotary cutter, loading means arrangeable in use to collect and convey broken rock cut by a rotary cutter mounted on the boom, and a transport arrangement for transporting roadway roof support sections towards the roadway roof.

12. An excavating machine for forming an underground roadway comprising a rotary cutter head, a boom having one end connected to the cutter head and having another end connected to a pivot means mounted on a first axis transverse to a direction of the roadway, rotary drive means mounted on the boom for rotating the rotary cutter head, a boom support member connected to the pivot means and extending rearward along the roadway from the pivot means along a second axis transverse to the first axis and parallel to a direction of the roadway, support means mounted in the roadway and connected to the boom support member for supporting the boom support member for rotational movement back and forth around the second axis which is parallel to a direction of the roadway, ram means connected to the boom and to a forward end of the boom support member spaced from the pivot means for pivotally moving the boom about the pivot means and for holding the boom in a desired position.

13. An excavating machine for forming an underground roadway at least a part of a rock boundary of which is of arcuate form, comprising a cutter unit and a stay unit, each of which is anchorable in the roadway and each of which is releasable and advanceable along the roadway with respect to the other unit, advancing means for advancing in use the currently released unit with respect to the currently anchored unit, a boom support member carried by the cutter unit for rotational movement about an axis longitudinally extending along the roadway, a forwardly directed, rotary cutter-carrying boom pivotally mounted on the boom support member, rotary cutter and rotary cutter drive means mounted on the boom, ram means for controlling pivotal movement of the boom, a rotating mechanism mounted on the cutter unit and connected to the boom support member for rotating the boom support member about said axis such that in use the rotary cutter mounted on the boom cuts the arcuate form of the rock boundary, and loading means arrangeable in use to collect and convey broken rock cut by the rotary cutter.

14. An excavating machine for forming an underground roadway at least a part of a rock boundary of which is arcuate form, comprising a cutter unit and a stay unit, the cutter unit having a floor mounted skid arrangement, and a roof support shield carried by the upright support component and arrangeable around at least a portion of the arcuate form of the rock boundary, each of the units being anchorable in the roadway and being releasable and advanceable along the roadway with respect to the other unit, advancing means for advancing in use the currently released unit with respect to the currently anchored unit, a boom support member carried by the cutter unit for rotational movement about an axis longitudinally extending along the roadway, a forwardly directed, rotary cutter-carrying boom pivotally mounted on the boom support member, rotary cutter and, rotary cutter drive means mounted on the boom, ram means for controlling pivotal movement of the boom, a rotary mechanism mounted on the cutter unit and connected to the boom support member for rotating the boom support member about said axis such that in use the rotary cutter mounted on the boom cuts the arcuate form of the rock boundary, and loading means arrangeable in use to collect and convey broken rock cut by the rotary cutter.

15. An excavating machine for forming an underground roadway at least a part of a rock boundary of which is of arcuate form, comprising a cutter unit and a stay unit, a member of guide rod means extending rearwardly from the cutter unit to slidably engage the stay unit, each of the units being anchorable in the roadway and being releasable and advanceable along the roadway with respect to the other unit, advancing means for advancing in use the currently released unit with respect to the currently anchored unit, a boom support member carried by the cutter unit for rotational movement about an axis longitudinally extending along the roadway, a forwardly directed, rotary cutter-carrying boom pivotally mounted on the boom support member, rotary cutter and rotary cutter drive means mounted on the boom, ram means for controlling pivotal movement of the boom, a rotating mechanism mounted on the cutter unit and connected to the boom support member for rotating the boom support member about said axis such that in use the rotary cutter mounted on the boom cuts the arcuate form of the rock boundary, and loading means arrangeable in use to collect and convey broken rock cut by the rotary cutter.

16. An excavating machine for forming an underground roadway at least a part of a rock boundary of which is of arcuate form, comprising a cutter unit and a stay unit, each of which is anchorable in the roadway and each of which is releasable and advanceable along the roadway with respect to the other unit, advancing means for advancing in use the currently released unit with respect to the currently anchored unit, a boom support member carried by the cutter unit for rotational movement about an axis longitudinally extending along the roadway, a forwardly directed, rotary cutter-carrying boom pivotally mounted on the boom support member, rotary cutter and rotary cutter drive means mounted on the boom, ram means for controlling pivotal movement of the boom, a rotating mechanism mounted on the cutter unit and connected to the boom support member for rotating the boom support member about said axis such that in use the rotary cutter mounted on the boom cuts the arcuate form of the rock boundary, loading means arrangeable in use to collect and convey broken rock cut by a rotary cutter mounted on the boom, slide element means provided on the boom, and slide means provided on the cutter unit so as to be slidably engaged by the slide element means to limit movement of the boom to within a preselected range.

* * * * *